US007791018B2

(12) United States Patent
King

(10) Patent No.: US 7,791,018 B2
(45) Date of Patent: Sep. 7, 2010

(54) ELECTRONIC READ-OUT CIRCUITS FOR PIXILATED/RESISTIVE CHARGE DETECTORS

(75) Inventor: Brian J. King, Dover, NH (US)

(73) Assignee: University of New Hampshire, Durham, NH (US)

( * ) Notice: Subject to any disclaimer, the term of this patent is extended or adjusted under 35 U.S.C. 154(b) by 1055 days.

(21) Appl. No.: 11/490,224

(22) Filed: Jul. 19, 2006

(65) Prior Publication Data

US 2007/0018092 A1 Jan. 25, 2007

Related U.S. Application Data

(60) Provisional application No. 60/700,907, filed on Jul. 19, 2005.

(51) Int. Cl.
*H01J 49/40* (2006.01)

(52) U.S. Cl. ..... 250/287; 250/281; 250/282; 702/28

(58) Field of Classification Search ..... 250/281, 250/282, 283, 286, 287, 288, 336.1, 339.07, 250/377, 378, 382, 393, 394, 384, 395; 702/22, 702/23, 26, 27, 28, 29
See application file for complete search history.

(56) References Cited

U.S. PATENT DOCUMENTS 4,117,332 A * 9/1978 Felton et al. ..... 250/374
5,367,162 A * 11/1994 Holland et al. ..... 250/287
6,797,960 B1 * 9/2004 Spartiotis et al. ..... 250/370.09
2005/0211893 A1 * 9/2005 Paschalidis ..... 250/287
2005/0230614 A1 * 10/2005 Glukhoy ..... 250/287

OTHER PUBLICATIONS

"XA Controller Readout System—Instructions", Ideas ASA, p. 1-27, May 2004.

"XA16_HR, Preliminary Documentation v1.5", Ideas ASA, p. 1-15, Oct. 2002.

Bollini et al, "Study of Efficiency of Multichannel Plate Detector used in PISA Experiment," The PISA Collaboration, IKP/COSY Annual Report 2000; p. 172 (2000).

* cited by examiner

*Primary Examiner*—Jack I Berman
*Assistant Examiner*—Nicole Ippolito Rausch
(74) *Attorney, Agent, or Firm*—Ropes & Gray LLP

(57) ABSTRACT

Methods and systems for measuring charges deposited on resistive and/or pixilated electrodes are described. The system includes a Time-of-Flight (TOF) detector with precise timing information provided by a discriminator implemented as a combination of a leading edge discriminator and a constant fraction discriminator. The discriminator initiates acquisition of the peak amplitude for accurate TOF measurements substantially independent of the signal amplitude at the input of the discriminator. The disclosed charge detection electronics has applications for space-based experiments.

11 Claims, 8 Drawing Sheets

ELECTRONIC READ-OUT CIRCUITS FOR PIXILATED/RESISTIVE CHARGE DETECTORS

CROSS-REFERENCE TO RELATED APPLICATIONS

This application claims the benefit of Provisional Application No. 60/700,907, filed on Jul. 19, 2005, the contents of which are incorporated herein by reference in their entirety.

FIELD OF THE INVENTION

The invention is directed to electronic circuits for detecting and processing signals derived from pixilated and/or resistive charge sensors. The electronic circuitry is particularly suited for the analysis of charged particles in space-based telescopes incorporating Time-of-Flight (TOF) measurement systems.

BACKGROUND OF THE INVENTION

Ion species such as $H^+$, $He^{2+}$, $He^+$ and $O^+$ comprise the majority of total mass density of plasma in the solar system and can trigger severe magnetic storms if they collide into the Earth's atmosphere. This phenomenon produces powerful eruptions, commonly referred to as Coronal Mass Ejections (CME), that may result in power outages and disable communication satellites. High-flying satellites can carry equipments to detect and analyze the ion species before these species intersect the satellites' orbits, so that sensitive electronic components contained in the satellites can be shut down in a timely fashion to prevent damages from CME.

A detection system for determining the ion species can be based on Time-of-Flight (TOF) measurements which measure the arrival time of the ions at a detector after the ions pass through a known electrostatic acceleration field. An accurate determination of the ion flux and the ion species requires a precise determination of the total charge incident on the detector and the time-of-flight of the ions between the electrodes. The accuracy of these detectors is as good as their detection sensitivity and detection speed, which depends on detector design, in particular the uniformity of the detector, as well as the design of the detection electronics which requires efficient signal sensing and shaping.

Accordingly, there exists a need for a fast, compact, and efficient circuit that can provide precise timing signals from an anode charge detector while also accurately measuring the total received charge.

SUMMARY OF THE INVENTION

The invention addresses the deficiencies of the prior art by, in various embodiments, providing methods and systems for measuring charges deposited on resistive and/or pixilated electrodes. The system includes a Time-of-Flight (TOF) detector with precise timing information.

According to one aspect of the invention, a detection system for time-of-flight measurements of charged particles includes a charge sensor collecting a charge associated with the charged particles, a detector system measuring an amplitude and a time dependence of the collected charge, and a trigger circuit having a leading edge discriminator (LED) providing a start time and a constant fraction discriminator (CFD). The trigger circuit receives an input signal from an output of the detector system and outputs a trigger signal at a trigger time determined by the CFD, with the trigger time following the start time.

According to another aspect of the invention, a time-of-flight detection (TOF) system for charged particles includes an electrostatic analyzer separating incident ions according to their charge-to-mass ratio, an ionizing target for changing an ionization state of the ions and producing electrons, a charge multiplier for providing amplification of the produced electrons, a charge detector for detecting an accumulated charge of the amplified electrons, and a detector system that measures an amplitude and a time dependence of the collected charge. The detector system is comprised of a trigger circuit having a leading edge discriminator (LED) providing a start time and a constant fraction discriminator (CFD), as well as an analog-to-digital (A/D) converter. The trigger circuit receives an input signal from an output of the detector system and outputs a trigger signal to the A/D converter at a trigger time determined by the CFD, wherein the trigger time is subsequent to the start time.

According to yet another aspect of the invention, a method for producing an amplitude-independent trigger signal for time-of-flight detection (TOF) measurements includes the steps of collecting a charge associated with incident charged particles, determining a start time after which the charge is collected, measuring an amplitude and a time dependence of a signal representative of the collected charge, forming a time derivative of the amplitude and an integral of the amplitude over time, and providing the trigger signal, after the start time, at a time when the time derivative is substantially equal to the integral during the time window.

Embodiments of the invention may include one or more of the following features. The A/D converter may provide a digital output signal representative of a value, for example, a peak value, of the collected charge. The detector system may also a shaping amplifier for shaping charge pulses received from the charge sensor and a charge-sensitive preamplifier connected upstream of the shaping amplifier. The CFD may include a differentiator that forms a time derivative of the input signal, an integrator that integrates the input signal over time, and a comparator that compares output signals from the differentiator and the integrator, whereby the trigger signal is generated when the output signal from the differentiator is substantially equal to the output signal from the integrator. This has the advantage that the trigger signal tends to be substantially independent of a magnitude of the input signal received by the trigger circuit.

BRIEF DESCRIPTION OF THE DRAWINGS

These and other features and advantages of the invention will be more fully understood by the following illustrative description with reference to the appended drawings, in which elements are labeled with like reference designations and which may not be to scale.

DETAILED DESCRIPTION OF CERTAIN ILLUSTRATED EMBODIMENTS

The invention, in various embodiments, provides systems, methods and devices for measuring and analyzing the charge of ions incident on a detector, in particular a pixilated and/or resistive anode detector.

Figure 1:
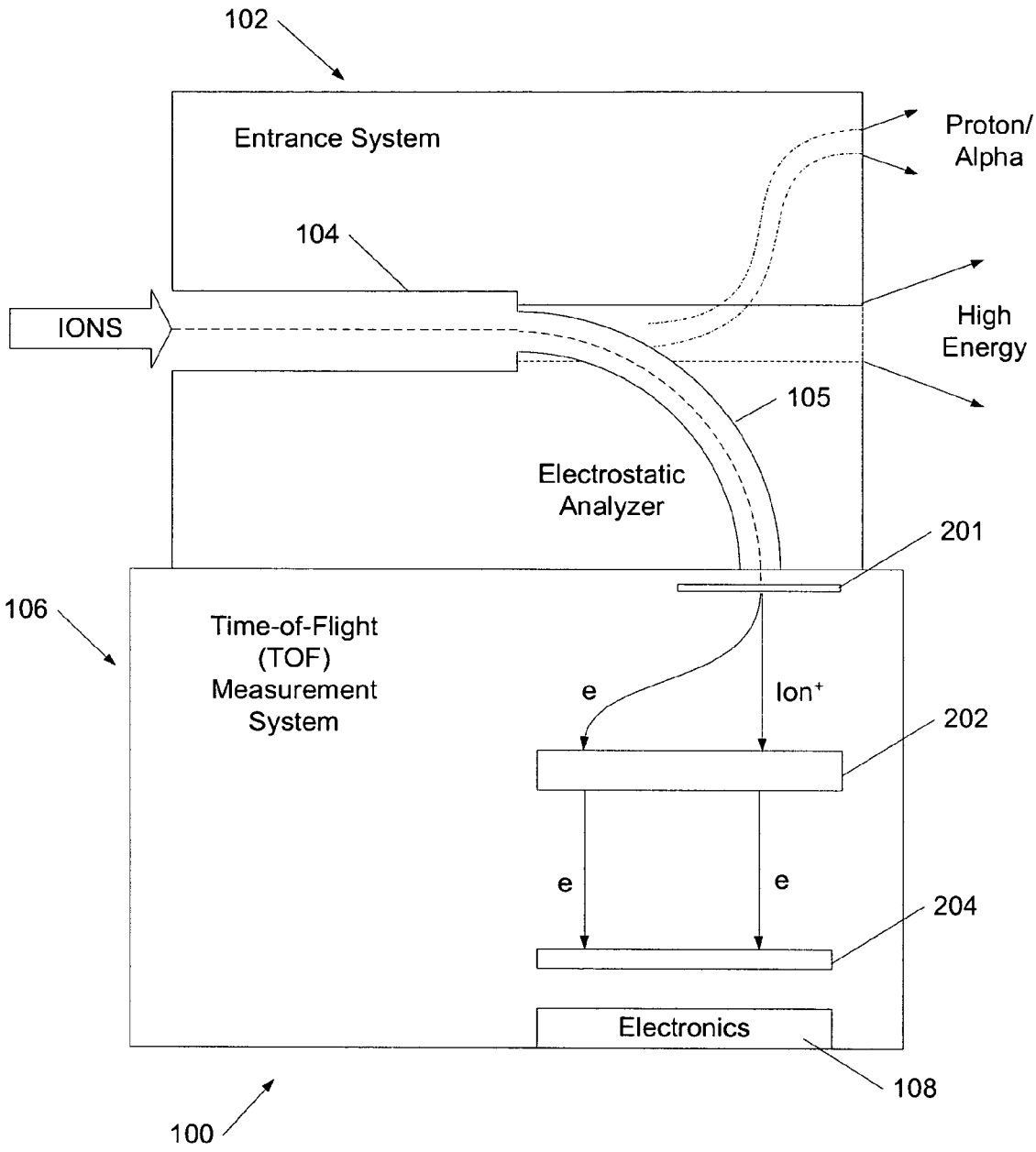
FIG. 1 illustrates an exemplary electrostatic analyzer for ion species detection.

FIG. 1 illustrates a multi-faceted electrostatic analyzer 100 for providing a 3D distribution function of major ion species over a range of 200 eV/e to 100 keV/e. The analyzer 100 includes a combination of an analyzer entrance system 102 and a Time-of-Flight (TOF) measurement system 106. The analyzer entrance system 102, configured as a dome with 360° degree coverage, accelerates an incoming particle in an acceleration zone 104 by an applied potential of between approximately 20V and approximately 13.6 kV. The incoming particles are separated by the entrance system 102 into light particles (protons, alpha), which are easily deflected in a electrostatic/magnetic field, and high-energy particles which pass the entrance system in an almost straight path. The particles of interest then enter an electrostatic analyzer 105 which separates the particles according to their mass M and charge Q. The particles then enter the TOF measurement system 106 where they are once more accelerated by a potential $U_{acc}$ of about −15 kV to about −25 kV. The particle then traverses the TOF measurement system 106 which will be described below in detail.

Figure 2:
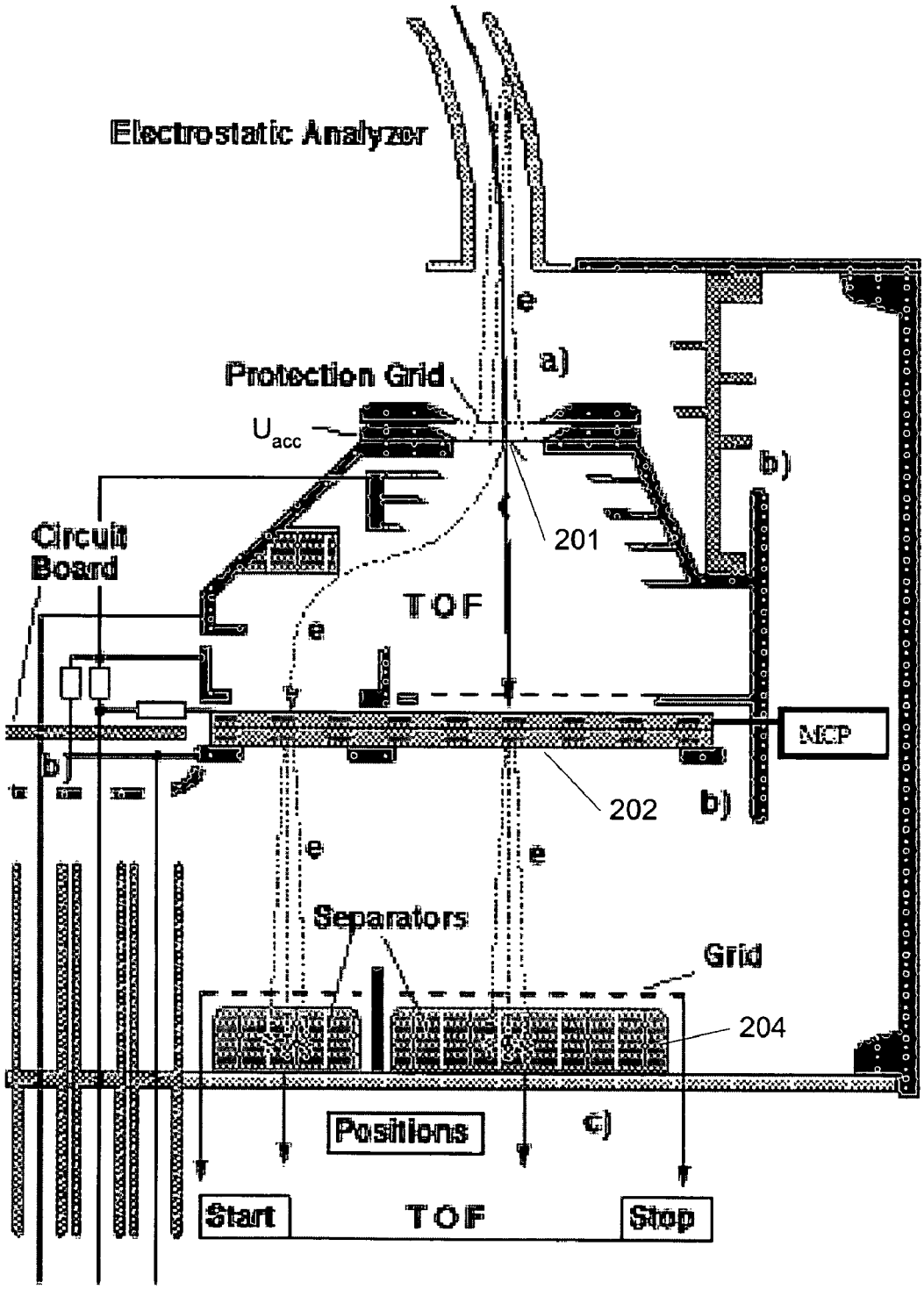
FIG. 2 illustrates an exemplary time-of-flight (TOF) system of the detection system of FIG. 1.

FIG. 2 provides an illustrative embodiment of the TOF system 106 of the electrostatic analyzer 100. In particular, the TOF system 106 includes a (usually thin) foil 201, a multi-channel plate (MCP) 202 and one or more anodes 204. In operation, an ion with an appropriate energy passes through the foil 201, knocking out electrons, whereby the ions become positively ionized. The electrons are deflected, thereby separating them from the ions. Both the electrons and the ions collide with the MCP 202. This collision causes the MCP 202 to emit an avalanche of secondary electrons, approximately $10^7$ secondary electrons for each incident charged particle. This large amplification of the signal makes MCPs useful for detecting charge particles. The secondary electrons then impinge on the anodes 204, where the accumulated charge can be converted to an electric signal and measured by an anode detector for obtaining time-, energy- and position-resolved information of the electrons. An exemplary anode detector will be described below.

The mass per charge (M/Q) of the particle can then be calculated as:

$$M/Q=2\cdot(E/Q+U_{acc})\cdot\alpha\cdot(\tau/d)^2,$$

where E/Q is the energy per charge from the analyzer 102, $U_{acc}$ is the post-acceleration zone voltage, $\alpha$ denotes the energy and species-dependent energy loss in the foil 201 at the entrance of the TOF system 106, $\tau$ denotes the measured time of flight, and d is a length of the particle's flight path in the TOF system 106.

In certain embodiments, the MCP 202 is fabricated by stretching a bundle of glass capillaries and then slicing the bundle to produce plates having about 2 to about 5 cm cross-sectional diameter and about several hundred microns thickness. In certain embodiments, each glass capillary has a diameter of about 10 μm and is coated with a secondary electron emitter in its interior peripheral surface to create a distributed resistance. An applied voltage between two ends of a capillary creates an electric field which causes a free electron in the capillary to trigger an avalanche of secondary electrons by striking the interior surface of the capillary. In certain implementations, two or more MCPs may be combined to produce a high gain in response to incident radiation from a primary electron source.

Incident radiation is used to impart sufficient energy to individual electrons in the MCP to stimulate electron flows. Incident radiation may be in the form of electromagnetic waves. Other examples of stimulation-causing excitation include changed optical states and vibrations imparting phonons in lattices.

Radiation detectors, such as the anodes 204, collect charge on electrodes in response to incident radiation. In certain embodiments, the anodes 204 are pixilated. In certain embodiments, the anodes are mesh grids or tin-over-copper plates where the tin is used to prevent oxidation. Anodes may be made from thin sheets of metal. Anodes may be conductively-coated substrates sprayed with paint containing, for instance, traces of graphite. Anodes may be substrates resistively-coated with a film of, for example, DuPont Series Q-Q SIL TM QS 87 resistor material. A resistive anode is dual-ended for facilitating the acquisition of the position of charge deposition on the anode.

Figure 3:
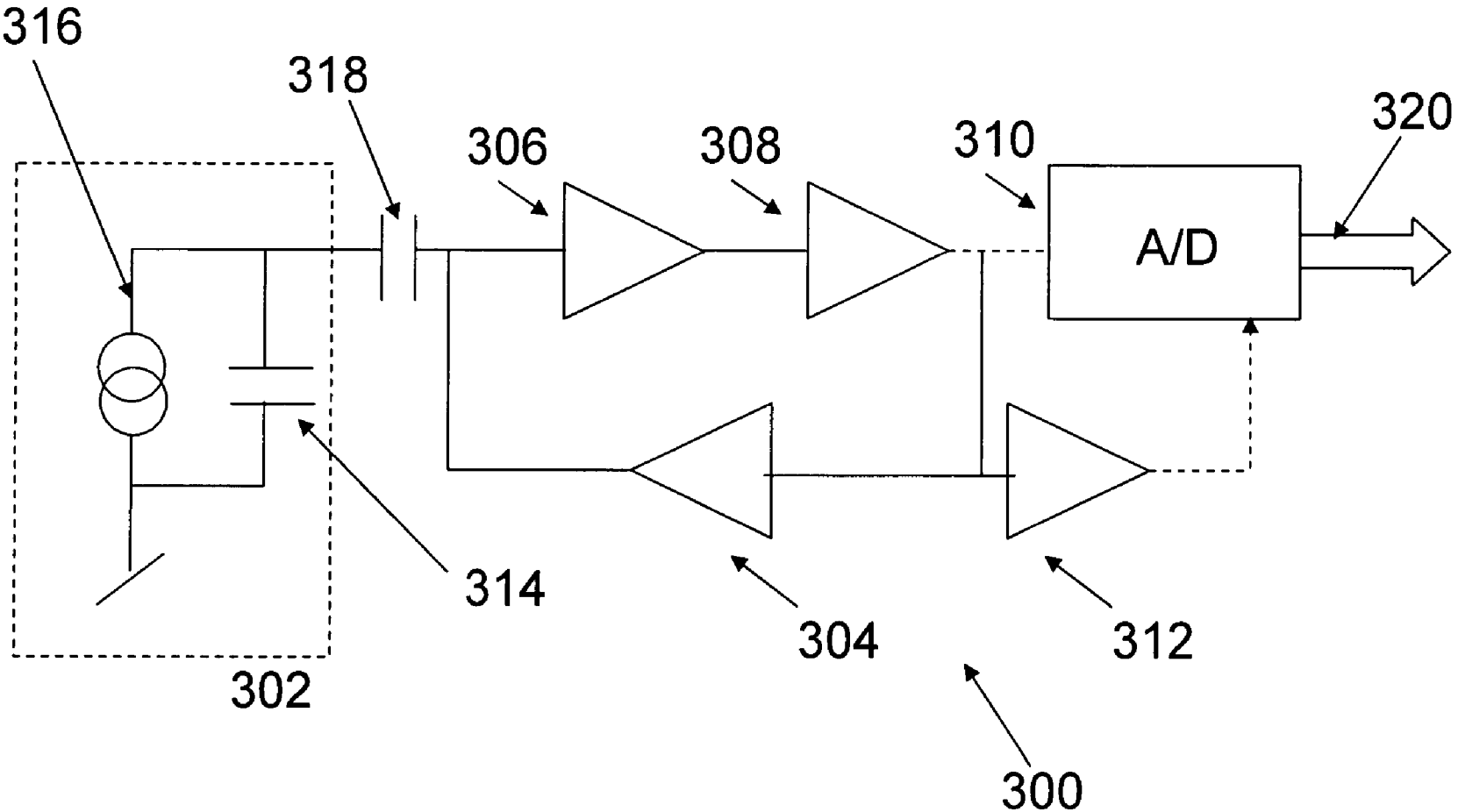
FIG. 3 illustrates an exemplary block circuit diagram of the TOF system of FIG. 2.

FIG. 3 illustrates in a high-level circuit diagram a charge detection system according to the present invention. The system 300 is used for sensing charge of electrons deposited from a MCP onto one or more anodes. In particular, the system 300 converts the charge into an electric signal and produces measurements that are used to provide time, energy and/or position-related information of the electrons. In one embodiment for testing purposes, the detector 300 includes a circuit component 302 that generates a model signal pulse representing the electric effect from excitation of electrons in one or more MCPs in a TOF system. One or more MCPs connected in series may be employed for achieving a high electron amplification. Circuit component 302 includes a shunt capacitor 314 connected in parallel with a current source 316. The shunt capacitor 304 models the capacitance formed between the anodes and the ground in TOF measurement system 106. The anodes may be resistive and may operate as a diffused RC transmission line. The signal generated by circuit component 302, or an actual signal detected by anodes 204, is capacitively coupled via capacitor 318 to a preamplifier 306 for amplifying the pulses, a shaping amplifier 308 for delaying the pulse height and for filtering the pulses' high-frequency content, a Baseline Restore (BLR) circuit 304 for restoring baseline or DC point of the pulses, a discriminator 312 for provide accurate triggering of pulse peak amplitude measurement, and an analog-to-digital converter (ADC) 310 for peak amplitude sampling and providing a digital output signal representing the collected charge for a certain mass-to-charge ratio of the detected ions. The detail of each of these components will be discussed below. Even though the following illustrative components are provided for unipolar pulse shapes, bipolar pulses may also be used.

Figure 4:
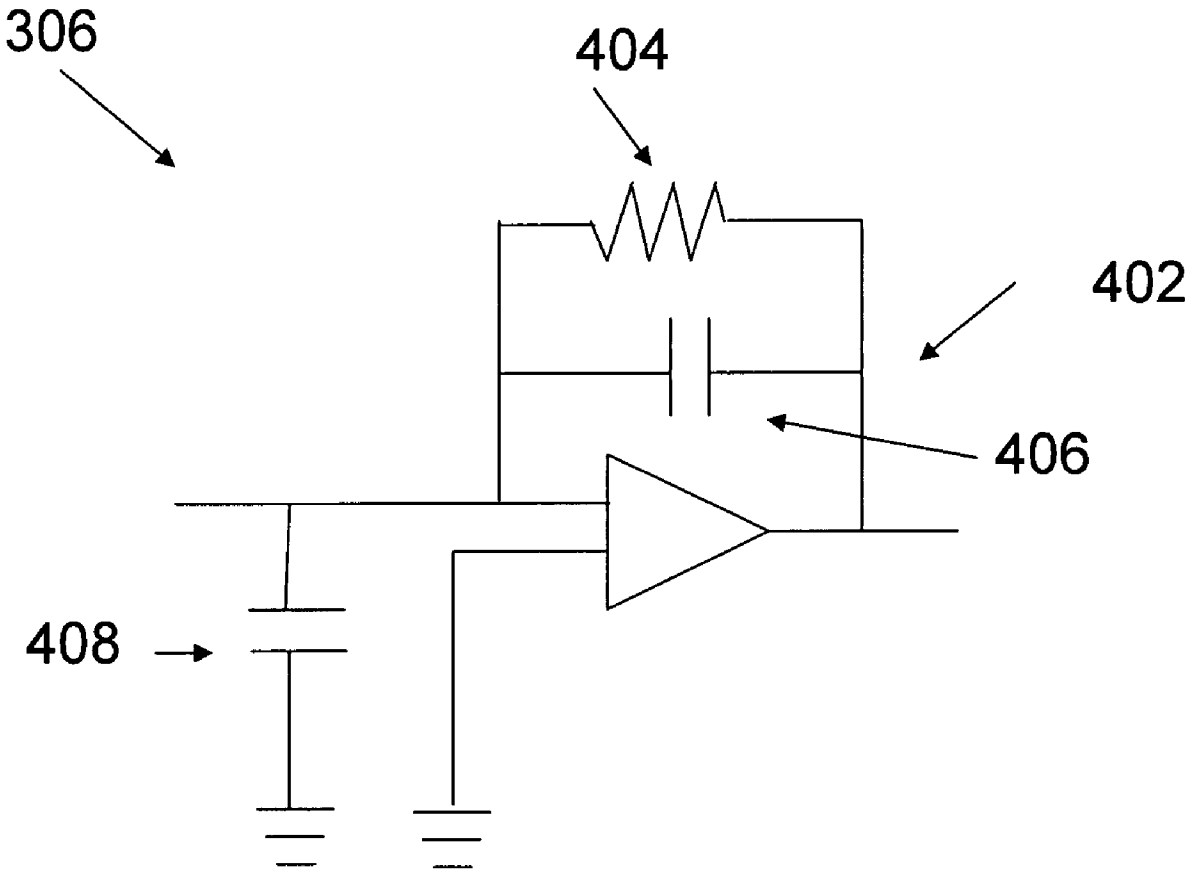
FIG. 4 illustrates an exemplary circuit diagram of the preamplifier of FIG. 3.

In a preferred implementation, the preamplifier 306 is configured as a charge-sensitive preamplifier, which is preferable over a voltage-sensitive preamplifier, since voltages of semiconductor detectors can vary with operating parameters, such as temperature. Charge-sensitive amplifiers should have sufficient amplification to achieve an optimal signal-to-noise ratio. FIG. 4 shows a schematic circuit diagram of a charge-sensitive preamplifier 306 that may be used in the charge detection system 300. Charge-sensitive preamplifier 306 includes an input capacitor 408 and a feedback loop 402 having a feedback resistor 404 and a feedback capacitor 406. The feedback resistor 404 discharges the feedback capacitor 406 to prevent saturation of the amplifier 306. The feedback capacitor 406 is in the order of about 1 pF, and the feedback resistor 404 is about 1 M to about 100 M ohms. The output of the preamplifier 306 decays exponentially with a time constant ranging from about 1 μs to about 10 μs.

However, as count rates increase, pulses from the preamplifier 306 are likely to be superimposed, which raises the pulse height and therefore changes the pulse information. This effect can be lessened, for example, by decreasing the time constant of the preamplifier 306 through a decrease in the resistance 404 or in the capacitance 406 of the feedback network 402 of the preamplifier 306, but this increases noise in the detection system 300.

Figure 5:
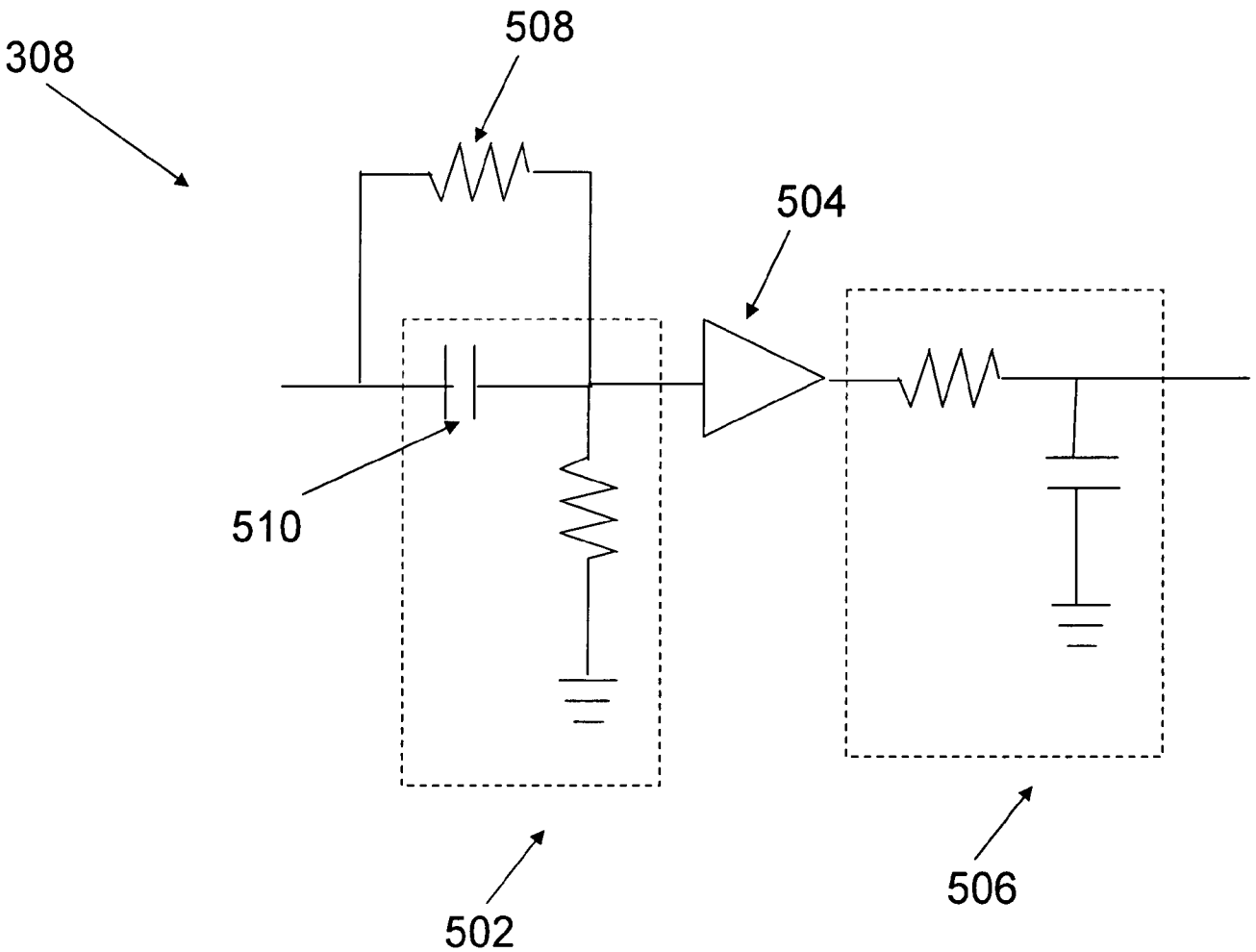
FIG. 5 illustrates an exemplary circuit diagram of the shaping amplifier of FIG. 3.

FIG. 5 illustrates an exemplary implementation of the shaping amplifier 308 of FIG. 3 introduced to lessen the effect of pulse superposition and to reduce high-frequency signal content. In one exemplary implementation, shaping amplifier 308 includes a first CR circuit 502 designed to shorten the width of the received pulse. However, CR circuit 502 introduces high-frequency components in the form of noise which may be smoothed by adding a buffer amplifier 504 and an RC circuit 506. The additional filtering introduced by the RC-buffer amplifier combination makes the shape of the output signal from the CR stage 502 more Gaussian, which also increases spectral resolution and facilitates amplitude sampling. This Gaussian shape is determined by the time constants $\tau_1$ and $\tau_2$, respectively, of the CR 502 and RC 506 stages and therefore has a predetermined mathematical relationship with the pulse received at the input of shaping amplifier 308. In some examples, the time constants $\tau_1$ and $\tau_2$ are about equal.

If the decay time of the preamplifier 306 is much shorter than the shaping time of the CR circuit 502, the signal may lose its base line or zero DC point and may start to undershoot below zero, causing errors in the subsequent peak amplitude measurement. This situation can be remedied and the undershoot lessened by adding a pole-zero cancellation resistor 508 in parallel with the capacitor 510 of the first CR stage 502, where the resistance value of the resistor 508 is selected to maintain the baseline through voltage division of the input signal. An additional capacitor (not shown) may be connected downstream of the shaping amplifier 308 to prevent feedback of the DC component of the shaping amplifier 308 to the input of the charge-sensitive preamplifier 306. Shaping amplifier 308 is hence comprised of a combination of the CR stage 502, the pole-zero cancellation resistor 508, the buffer amplifier 504, and the RC stage 506.

Any remaining shift in the baseline can be corrected by using a baseline restore (BLR) circuit 304 shown in FIG. 3. The BLR circuit 304 resets the zero point after each pulse in the absence of an input signal. The BLR circuit 304 samples the output of shaping amplifier 308 and compares the output to a reference value of the preamplifier 306. A correction voltage is then added at the last AC-coupled junction of the charge detection system 300, for example, after capacitor 318 and before shaping amplifier 306. In a passive solution to the DC shift problem (not shown), the baseline can also be restored by using a diode to add current to the signal line between the preamplifier 306 and the shaping amplifier 308 whenever the signal drops below the baseline.

Figure 6:
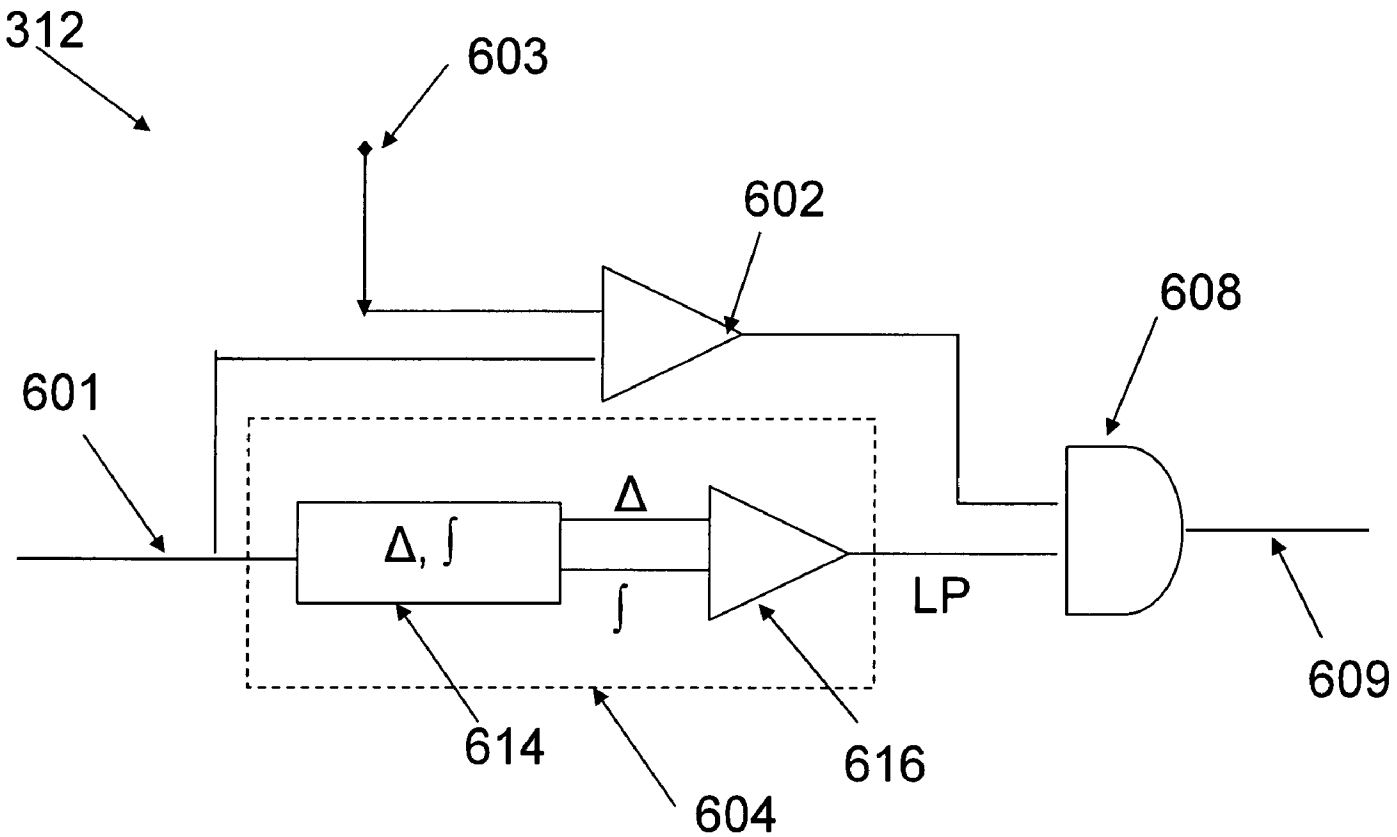
FIG. 6 illustrates an exemplary block circuit diagram of the discriminator of FIG. 3.

The magnitude of the signal at the output of the shaping circuit 308 contains information about the total charge deposited on the detector and must therefore also be accurately determined. The magnitude of the signal pulses may be determined by triggering around the signal's peak amplitude. Hence consideration of the leading edge of a pulse and its slope bears significant correlation to the accuracy of the measurement. The disclosed discriminator circuit 312 of FIG. 3 is shown in more detail in FIG. 6. Discriminator circuit 312 provides at its output 609 a trigger signal for the D/A converter 310 (FIG. 3). The input 601 of discriminator circuit 312 is coupled to the output of shaping amplifier 308. Discriminator circuit 312 employs, in combination, a Leading Edge Discriminator (LED) 602 and a Constant Fraction Discriminator (CFD) 604 with a lumped RC delay technique. The LED 602 operates by outputting a logic level signal between 0 V and +5 V if an input signal is above a predefined threshold as determined, for example, by a voltage applied to terminal 603. The time to reach the threshold is used as a start time, and not as an actual trigger time, as this time is not precisely correlated with the pulse peak amplitude and varies depending on the input signal's amplitude. The CFD 604 operates by generating in a first stage 614 from input signal 601 {f(t)} a differentiated signal $D=\Delta f/\Delta t$ and an integrated signal $I=f(t)\,dt$. The differentiated input signal D is then compared in a second stage 616 with the integrated input signal I to determine a crossing point at a time $\tau$ which will then be used as a trigger, as described below. This crossing point is essentially independent of the amplitude of input signal 601, i.e., it remains consistent to a fractional point of the input signal's amplitude, and the CFD 604 generates a logic pulse LP of, for example, +5V at a zero crossing.

The logic output signal LP of CFD 604 is transmitted to one of two inputs of a D-flip-flop 608, with the other input of D-flip-flop 608 connected to the output of LED 602. As mentioned above, output of LED 602 has a logic level of +5V when the input pulse 601 exceeds a threshold level set by a voltage at input 603. The +5V output from LED 602 enables D-flip-flop 608 which goes to +5V at output 609 once logic pulse LP of, for example, +5V from CFD 604 is also present at the input of D-flip-flop 608.

Output signal 609 from D-flip-flop then triggers the ADC 310 at a precise time independent of the amplitude of the input signal to ADC 310.

Figure 7A:
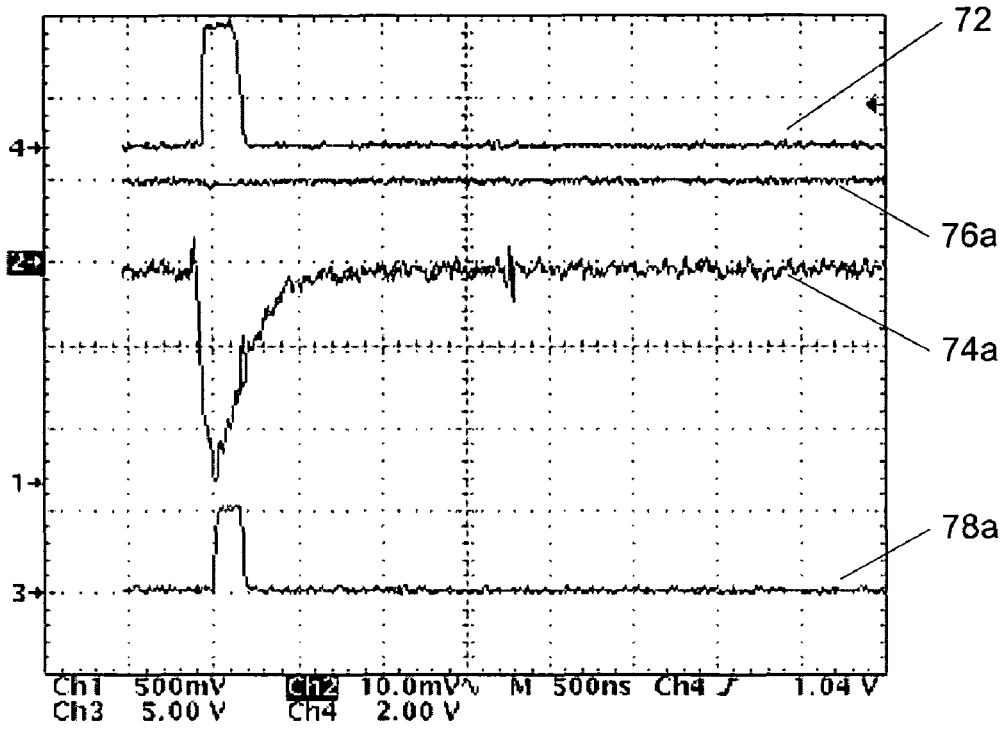
FIGS. 7A-C show recovered trigger signals at the discriminator for small, intermediate and large input signals of the circuit of FIG. 3.
Figure 7B:
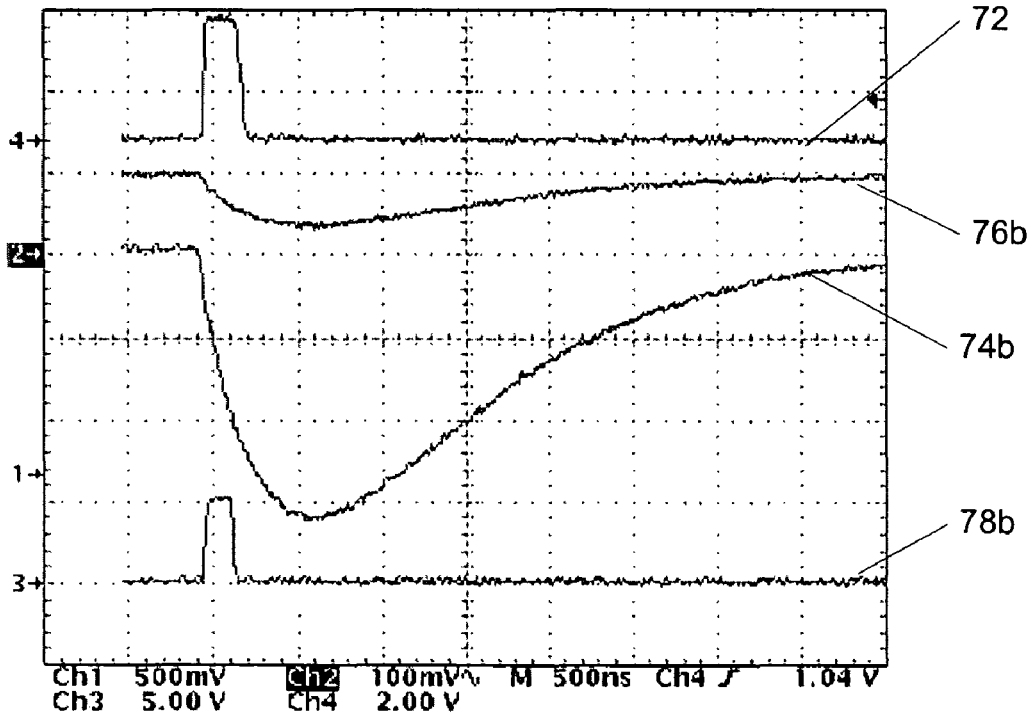
Figure 7C:
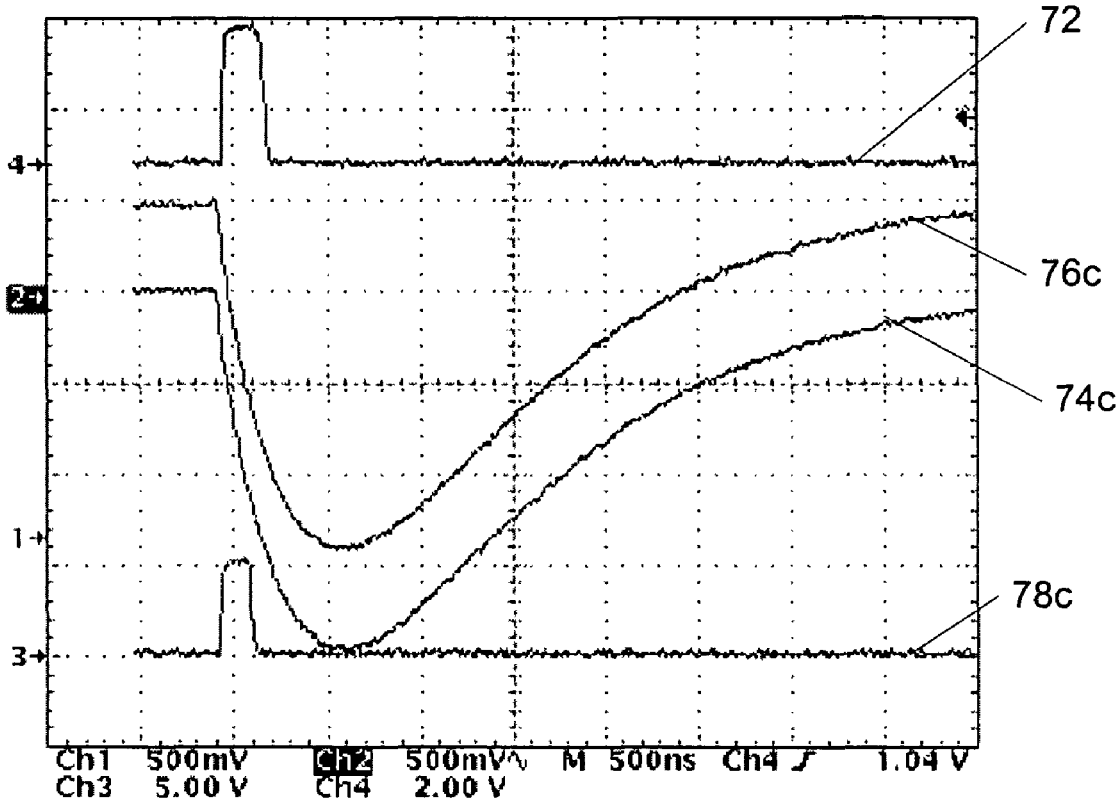

The accuracy and robustness of the trigger signal derived at the output of D-flip-flop 608 is demonstrated in FIGS. 7A to 7C. The signals are generated by circuit component 302 (FIG. 3) which is triggered by a trigger signal 72. The circuit component 302 provides exemplary model output signals 74*a*, 74*b*, 74*c* of different magnitude, as indicated by the different sensitivity settings of oscilloscope Channel 2. Output signals 74*a*, 74*b*, 74*c* are measured at the output of circuit component 302 and before capacitor 318. Curve 74*a* of FIG. 7A has a peak amplitude of approximately 25 mV (10 mV/div), curve 74*b* of FIG. 7B has a peak amplitude of approximately 320 mV (100 mV/div), and curve 74*c* of FIG. 7C has a peak amplitude of approximately 2 V (500 mV/div). Corresponding curves 76*a*, 76*b*, 76*c* are measured downstream of capacitor 318 before preamplifier 306. As seen in FIG. 7A, the peak signal of curve 76*a* at the trigger signal 72 is almost indiscernible from the baseline, whereas the peak signals of curves 76*b* and 76*c* are clearly visible.

Curves 78*a*, 78*b* and 78*c* in FIGS. 7A, 7B and 7C, respectively, show the trigger signal for the A/D converter 310 (FIG. 3) determined from the input signal with the system and method of the invention. A comparison between curves 78*a*, 78*b* and 78*c* demonstrates that the trigger signal for the A/D converter 310 coincides with the trigger signal 72 used to generate the output signals 74*a*, 74*b*, 74*c*, respectively, independent of the signal amplitude.

In summary, the disclosed system achieves a low power solution with a wide dynamic input range of 100:1 and capable of achieving a periodic rate of 0.75 MHz. The system also utilizes a simple interface for an ADC with sub-nano second resolution. Amplifiers were simulated, using standard simulation techniques, and manufactured to provide the charge and shaping functions. Two different exemplary amplifiers were constructed: (1) a wideband amplifier with open loop gain of 48 dB and a 0 dB cut-off at 140 MHz, and (2) an amplifier with an open loop gain of 44 dB and a 0 dB cut-off at 100 MHz. In addition, a constant fraction discriminator with picosecond resolution was built to provide precise timing independent of the peak charge incident on the anodes.

Those skilled in the art will know or be able to ascertain using no more than routine experimentation, many equivalents to the embodiments and practices described herein. Accordingly, it will be understood that the invention is not to be limited to the illustrative embodiments disclosed herein. While the invention has been disclosed in connection with the preferred embodiments shown and described in detail, various modifications and improvements may be made thereto without departing from the spirit and scope of the invention.

I claim:

1. A detection system for time-of-flight measurements of charged particles, comprising:

a charge sensor collecting a charge associated with the charged particles;

a detector system measuring an amplitude and a time dependence of the collected charge; and a trigger circuit having a leading edge discriminator (LED) providing a start time and a constant fraction discriminator (CFD), said trigger circuit receiving an input signal from an output of the detector system; wherein:

the trigger circuit provides a trigger signal at a trigger time determined by the CFD, with the trigger time following the start time; and the CFD comprises:

a differentiator that outputs a time derivative of the input signal, an integrator that outputs a value of the input signal integrated over time, and a comparator that compares the time derivative of the input signal to the value of the input signal integrated over time to determine the trigger time.

2. The system of claim 1, further comprising an analog-to-digital (A/D) converter receiving the trigger signal and providing a digital output signal representative of a peak value of the collected charge.

3. The system of claim 1, wherein the detector system comprises a shaping amplifier for shaping charge pulses received from the charge sensor.

4. The system of claim 3, further comprising a charge-sensitive preamplifier connected upstream of the shaping amplifier.

5. The system of claim 1, wherein the trigger signal is generated when the time derivative of the input signal is substantially equal to the integrated value of the input signal over time.

6. The system of claim 1, wherein the trigger signal is substantially independent of a magnitude of the input signal received by the trigger circuit.

7. A time-of-flight detection (TOF) system for charged particles, comprising:

an electrostatic analyzer separating incident ions according to their charge-to-mass ratio;

an ionizing target for changing an ionization state of the ions and producing electrons;

a charge multiplier for providing charge amplification;

a charge detector for collecting an amplified charge; and a detector system measuring an amplitude and a time dependence of the collected charge; wherein:

said detector system comprises:

a trigger circuit having a leading edge discriminator (LED) providing a start time and a constant fraction discriminator (CFD), said trigger circuit receiving an input signal from an output of the detector system, and an analog-to-digital (A/D) converter;

the trigger circuit provides a trigger signal to the A/D converter at a trigger time determined by the CFD, with the trigger time following the start time; and the CFD comprises:

a differentiator that outputs a time derivative of the input signal, an integrator that outputs a value of the input signal integrated over time, and a comparator that compares the time derivative of the input signal to the value of the input signal integrated over time to determine the trigger time.

8. The system of claim 7, wherein the trigger signal is generated when the time derivative of the input signal is substantially equal to the integrated value of the input signal over time.

9. The system of claim 7, wherein the charge multiplier comprises a multi-channel plate.

10. A method for producing an amplitude-independent trigger signal for time-of-flight detection (TOF) measurements, comprising:

collecting a charge associated with incident charged particles;

determining a start time after which the charge is collected;

measuring an amplitude and a time dependence of a signal representative of the collected charge;

forming a time derivative of the amplitude and an integral of the amplitude over a time window;

comparing the time derivative of the amplitude and the integral of the amplitude over the time window; and providing a trigger signal, after the start time, at a time when the time derivative is substantially equal to the integral during the time window.

11. The method of claim 10, wherein the trigger signal is substantially independent of the amplitude.

* * * * *